US012799693B2

(12) United States Patent
Neusch

(10) Patent No.: US 12,799,693 B2
(45) Date of Patent: Nov. 17, 2026

(54) PASSIVE CABLE BARRIER SYSTEM

(71) Applicant: Black Security Products, LLC, Kalispell, MT (US)

(72) Inventor: Stephen Neusch, Kalispell, MT (US)

(73) Assignee: Black Security Products, LLC, Austin, TX (US)

( * ) Notice: Subject to any disclaimer, the term of this patent is extended or adjusted under 35 U.S.C. 154(b) by 583 days.

(21) Appl. No.: 18/137,651

(22) Filed: Apr. 21, 2023

(65) Prior Publication Data

US 2024/0352690 A1 Oct. 24, 2024

(51) Int. Cl.

*E01F 15/06* (2006.01)
*E04H 17/02* (2006.01)
*E04H 17/10* (2006.01)

(52) U.S. Cl.

CPC ..... *E01F 15/06* (2013.01); *E04H 17/124* (2021.01); *E04H 17/127* (2021.01)

(58) Field of Classification Search

CPC ..... E04H 17/10; E04H 17/124; E04H 17/127; E01F 15/06

See application file for complete search history.

(56) References Cited

U.S. PATENT DOCUMENTS 2,201,313 A * 5/1940 Hayden ..... E01F 15/06 256/13.1
7,364,137 B2 † 4/2008 Neusch
7,556,242 B2 † 7/2009 Alberson
10,174,471 B2 * 1/2019 James ..... E01F 15/06
10,233,601 B2 * 3/2019 Gerrard ..... E04H 17/009
10,837,148 B2 * 11/2020 Gerrard ..... E01F 13/12
2007/0102689 A1 † 5/2007 Alberson
2020/0208362 A1 * 7/2020 Impero ..... E01F 15/06

FOREIGN PATENT DOCUMENTS

KR 20-0318128 * 6/2003 ..... E01F 15/06
KR 10-0847736 * 7/2008 ..... E01F 15/06
KR 10-0888196 * 3/2009 ..... E01F 15/06

OTHER PUBLICATIONS

Unified Facilities Criteria (UFC)—Security Engineering: Fences, Gates, and Guard Facilities, UFC 4-022-03, Jun. 14, 2007.†
Unified Facilities Criteria (UFC)—Selection and Application of Vehicle Barriers; UFC 4-022-02, Jun. 8, 2009; Change 1, Aug. 9, 2010.†
MASH 2016 TL4 Cable Barrier System Installation Guide, Version 10.0, Updated: Feb. 2022.†
Cass® S4 38" High Cable Safety System Product Description Assembly Manual, PN 62815 Revision A Apr. 2023.†

* cited by examiner
† cited by third party

*Primary Examiner* — Michael P Ferguson
(74) *Attorney, Agent, or Firm* — STINSON LLP

(57) ABSTRACT

A passive cable barrier system including end structural posts, middle structural posts, guide posts, and cables, and post connections configured to tighten and dissipate the force associated with a vehicular collision or similarly forceful impact inflicted on the cable.

19 Claims, 10 Drawing Sheets

PASSIVE CABLE BARRIER SYSTEM

FIELD

The present disclosure relates generally to net barrier systems. More specifically, this disclosure relates to a passive cable barrier system with structural posts, guide posts, and lightweight cables, to improve portability of barrier systems without compromising strength.

BACKGROUND

Vehicle barriers are sometimes used to provide access point control by denying unauthorized access to roadways, facilities, and other resources. For instance, vehicle barriers may be used to control access at entrances and exits of facilities and roadways, and to restrict vehicle access to unauthorized areas, such as areas reserved for pedestrian traffic. Vehicle barriers take many forms, including net barriers, cable barriers, wedge barriers, plate barriers, gates, bollards, and others.

Vehicle barriers may be either passive or active in nature. Specifically, passive vehicle barriers are fixed in a closed position where access is continuously denied, whereas active vehicle barriers can be selectively opened and closed. Further, vehicle barriers may be permanent or portable. Permanent vehicle barriers are typically permanently affixed to the ground where they are installed, such as through cementing the barrier into position; on the other hand, portable barriers are typically not permanently coupled to the ground, and thus may be transported and installed in various locations.

There are currently a variety of issues associated with cable barriers. First, cable barriers often require large compression clamps or spelter fittings to secure cables to posts, which is both costly and heavy. Second, cable barriers often require intricate time-consuming installation, including welding work. Finally, because of their weight and intricate installation requirements, cable barriers are typically cumbersome to transport and install.

Cable barrier systems that use fewer fittings, that are easy and quick to install, and that are portable, while simultaneously not compromising the cable barrier's ability to restrict vehicle access to unauthorized areas, are therefore needed.

SUMMARY

The passive cable barrier system disclosed herein improves on cable barrier systems technology by implementing a passive cable barrier system that uses cable tension to withstand the force associated with vehicular collisions or similar impacts. The passive cable barrier system includes end and middle structural posts that include post connections that are configured to route a cable in different directions, such the cable is in a state of tension and the post connections dissipate force in cases of a vehicular collision or similar impact. This passive cable barrier system simplifies fittings, reduces weight, and improves both transportability and ease of installation.

In light of the disclosure herein, and without limiting the scope of the invention in any way, in a first aspect of the present disclosure, which may be combined with any other aspect listed herein unless specified otherwise, a passive cable barrier system includes at least three structural posts and at least one cable. The at least three structural posts each include a structural base and a structural arm, the structural arm is fixedly coupled to the structural base, and the structural arm includes a post connection. The cable is coupled to the at least three structural posts at the post connection. A first structural post and a second structural post of the at least three structural posts are located on different sides of a third structural post of the at least three structural posts. The at least one cable is coupled to the at least three structural posts such that the at least one cable spans from the first structural post, to the third structural post, and to the second structural post.

In a second aspect of the present disclosure, which may be combined with any other aspect listed herein unless specified otherwise, the first and second structural posts further comprise end cable reinforcements.

In a third aspect of the present disclosure, which may be combined with any other aspect listed herein unless specified otherwise, each structural base further comprises a structural reinforcement.

In a fourth aspect of the present disclosure, which may be combined with any other aspect listed herein unless specified otherwise, the post connection comprises the cable wrapping around the structural arm at a desired height such that the cable makes at least one revolution around the structural arm, and a first end of the cable is directed in a first direction and a second end of the cable is directed in a second different direction, such that there is tension on the cable around the circumference of the structural arm.

In a fifth aspect of the present disclosure, which may be combined with any other aspect listed herein unless specified otherwise, the post connection further comprises a cable retention mechanism that defines a cable receiving area on the structural arm and is configured to receive the cable at a point where the first end of the cable and second end of the cable intersect, such that the cable receiving area is configured to receive at least two portions of the cable.

In a sixth aspect of the present disclosure, which may be combined with any other aspect listed herein unless specified otherwise, a passive cable barrier system includes at least three structural posts, at least one cable, and at least one guide post. The at least three structural posts each include a structural base and a structural arm, the structural arm is fixedly coupled to the structural base, and the structural arm includes a post connection. The cable is coupled to the at least three structural posts at the post connection. The at least one post each includes a guide base and a guide arm, the guide arm is fixedly coupled to the guide base, and the guide arm includes a guide post cable retention mechanism. A first structural post and second structural post of the at least three structural posts are located on different sides of a third structural post of the at least three structural posts. The at least one guide post is located between the third of the at least three structural posts and the first or second of the at least three structural posts. The at least one cable is coupled to the at least three structural posts and at least one guide post.

In a seventh aspect of the present disclosure, which may be combined with any other aspect listed herein unless specified otherwise, the first and second structural posts further comprise end cable reinforcements.

In an eight aspect of the present disclosure, which may be combined with any other aspect listed herein unless specified otherwise, each structural base further comprises a structural reinforcement.

In a ninth aspect of the present disclosure, which may be combined with any other aspect listed herein unless specified otherwise, the post connection comprises the cable wrapping around the structural arm at a desired height such that the cable makes at least one revolution around the structural arm, and a first end of the cable is directed in a first direction and a second end of the cable is directed in a second different direction, such that there is tension on the cable around the structural arm.

In a tenth aspect of the present disclosure, which may be combined with any other aspect listed herein unless specified otherwise, the post connection further comprises a cable retention mechanism that defines a cable receiving area on the structural arm and is configured to receive the cable at a point where the first end of the cable and second end of the cable intersect, such that the cable receiving area is configured to receive two portions of the cable.

In an eleventh aspect of the present disclosure, which may be combined with any other aspect listed herein unless specified otherwise, a passive cable barrier system includes two end structural posts, at least one middle structural post, at least one cable, and at least one guide post. The end structural posts each include a structural base and a structural arm, the structural arm is fixedly coupled to the structural base, and the structural arm includes a post connection. The end structural posts also each include at least one end cable reinforcement. The at least one middle structural post each includes a structural base and a structural arm, the structural arm is fixedly coupled to the structural base, and the structural arm includes a post connection. The cable is coupled to the end structural posts and at least one middle structural post at the post connections. The at least one guide post each includes a guide base and a guide arm, the guide arm is fixedly coupled to the guide base, and the guide arm includes a guide post cable retention mechanism. The end posts are located on a first and second end, such that the at least one middle structural post and at least one guide post are located between the first and second end. The at least one cable is coupled to the end structural posts, at least one guide post, and at least one middle structural post such that the cable spans from one of the two end structural posts to another of the two end structural posts and couples to the at least one guide post and at least one middle structural post, such that the cable forms a continuous boundary from one of the two end structural posts to the other of the two end structural posts.

In a twelfth aspect of the present disclosure, which may be combined with any other aspect listed herein unless specified otherwise, the first and second structural posts further comprise end cable reinforcements.

In a thirteenth aspect of the present disclosure, which may be combined with any other aspect listed herein unless specified otherwise, the structural base further comprises a structural reinforcement.

In a fourteenth aspect of the present disclosure, which may be combined with any other aspect listed herein unless specified otherwise, the post connection on the at least one middle structural post comprises the cable wrapping around the structural arm at a desired height such that the cable makes at least one revolution around the structural arm, and a first end of the cable is directed in a first direction and a second end of the cable is directed in a second different direction, such that there is tension on the cable around the circumference of the structural arm.

In a fifteenth aspect of the present disclosure, which may be combined with any other aspect listed herein unless specified otherwise, the post connection further comprises a cable retention mechanism that defines a cable receiving area on the structural arm and is configured to receive the cable at a point where the first end of the cable and second end of the cable intersect, such that the cable receiving area is configured to receive at two portions of the cable.

In a sixteenth aspect of the present disclosure, which may be combined with any other aspect listed herein unless specified otherwise, the post connection on the two end structural posts comprises the cable wrapping around the structural arm at a desired height such that the cable makes at least one revolution around the structural arm, and a first end of the cable and a second end of the cable are directed in same a direction, such that there is tension on the cable around the circumference of the structural arm.

In a seventeenth aspect of the present disclosure, which may be combined with any other aspect listed herein unless specified otherwise, the cable is comprised of a lightweight woven steel.

In an eighteenth aspect of the present disclosure, which may be combined with any other aspect listed herein unless specified otherwise, each structural base is comprised of concrete.

In a nineteenth aspect of the present disclosure, which may be combined with any other aspect listed herein unless specified otherwise, the post connection is configured such that a force on the first end of the cable or second end of the cable increases tension on cable portions in contact with the structural arm, to tighten the cable about the structural arm.

In a twentieth aspect of the present disclosure, which may be combined with any other aspect listed herein unless specified otherwise, the guide arm is comprised of at least one of a u-channel post or a square sign post.

Additional features and advantages of the disclosed devices, systems, and methods are described in, and will be apparent from, the following Detailed Description and the Figures. The features and advantages described herein are not all-inclusive and, in particular, many additional features and advantages will be apparent to one of ordinary skill in the art in view of the figures and description. Also, any particular embodiment does not have to have all of the advantages listed herein. Moreover, it should be noted that the language used in the specification has been selected for readability and instructional purposes, and not to limit the scope of the inventive subject matter.

BRIEF DESCRIPTION OF THE FIGURES

Understanding that figures depict only typical embodiments of the invention and are not to be considered to be limiting the scope of the present disclosure, the present disclosure is described and explained with additional specificity and detail through the use of the accompanying figures. The figures are listed below.

DETAILED DESCRIPTION

Figure 1:
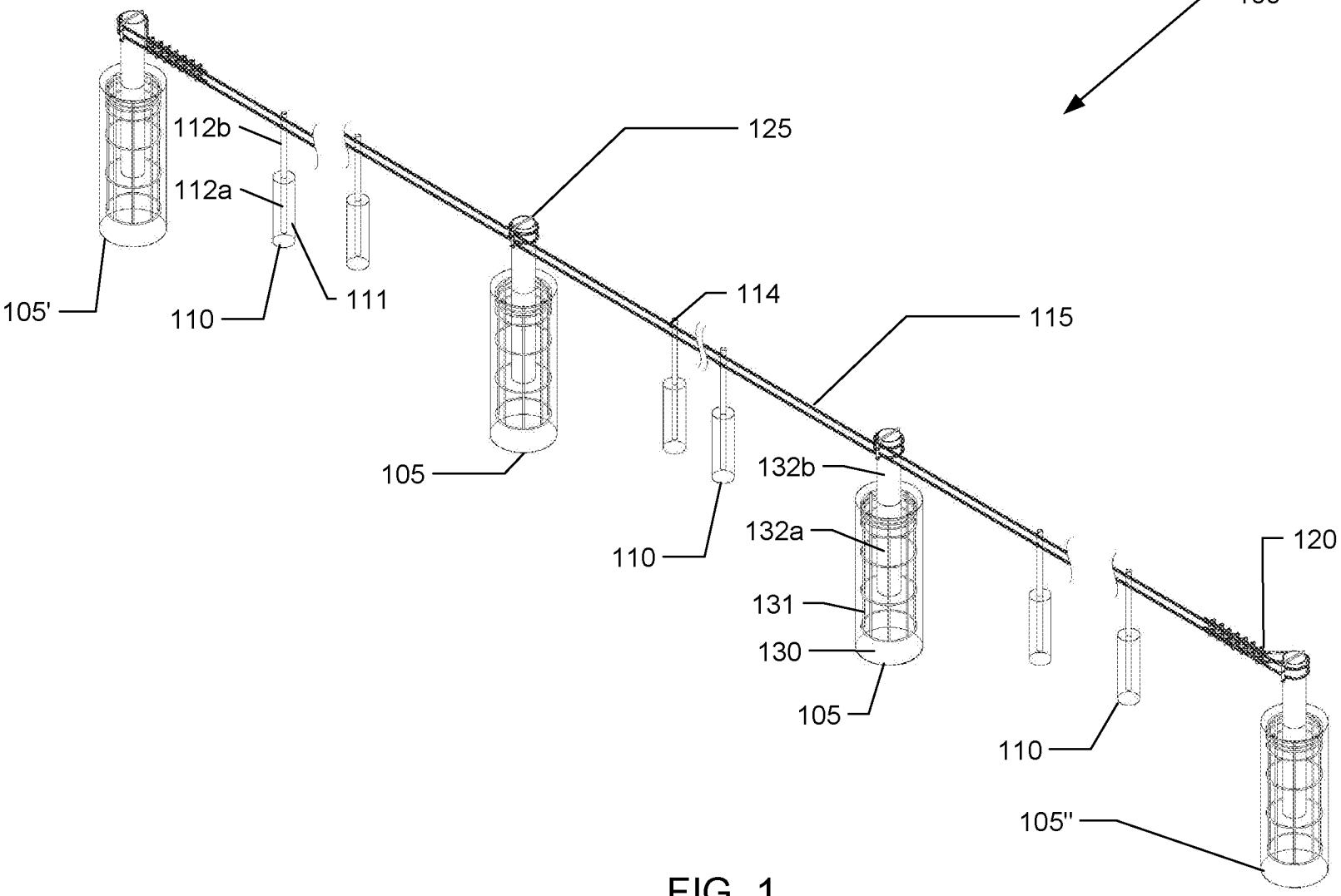
FIG. 1 illustrates a perspective view of a passive cable barrier system, according to an example embodiment of the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specific the presence of stated features, integers, steps, operations, elements, and/or components, but do not preclude the presence or additional of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent"). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Barrier System Overall

With reference to the Figures, FIG. 1 illustrates a perspective view of a passive cable barrier system 100, hereinafter referred to as cable barrier system 100 or barrier system 100. Generally, the passive cable barrier system 100 includes structural posts 105, guide posts 110, and at least one cable 115. In FIG. 1, the passive cable barrier system 100 includes two cables 115 disposed along its length; it should be appreciated, however, that alternate embodiments can include more or fewer cables 115. In an embodiment, the passive cable barrier system 100 has a structural post 105' on a proximal end and a structural post 105" on a distal end, so as to create "end posts" 105', 105" of the passive cable barrier system 100. Interspersed at distances between the end posts 105', 105" are middle structural posts 105 and guide posts 110. The number and order of structural posts 105 and guide posts 110 can vary in alternate embodiments. As seen in FIG. 1, the cables 115 are secured to the top of the end posts 105', 105", middle structural posts 105, and guide posts 110. Notably, the cables 115 are secured to the posts 105, 110, such that each single cable 115 spans across system 100 from a one end post 105' to the other end post 105", while also securing to any interspersed middle structural posts 105 and guide posts 110.

As further explained below, the cables 115 couple to the structural posts 105', 105", 105 via a cable retention mechanism 140 and to the guide posts 110 via a guide post cable retention mechanism 114. Importantly, the cables 115 are coupled to the posts 105', 105", 105, 110 so as to create tension on the cable 115 across the length of the passive cable barrier system 100. The cables 115 can be coupled to the posts 105, 110 at varying heights. For example, the cables 115 can be installed at car height, but also at lower or higher heights. Relatedly, the cables 115 are made of a durable, lightweight material, such as woven steel, and are capable of withstanding the force of a vehicular collision or large impact. It should be noted the passive cable barrier system 100 could be installed such that forms a straight line, but a person skilled in the art could install the passive cable barrier system 100 in a variety of different configurations, so that it could defines irregular boundaries like a circular or triangular area.

As seen in FIG. 1, the passive cable barrier system 100 includes components that are installed below the ground, and components that extend above ground. Specifically, the structural posts 105', 105", 105 include a structural base 130 and structural reinforcement 131, which are both subterranean, and a structural arm with a subterranean portion 132*a* and an above-ground portion 132*b*. Similarly, the guide posts 110 include a guide base 111 and a guide arm with a subterranean portion 112*a* and an above-ground portion 112*b*.

Figure 3A:
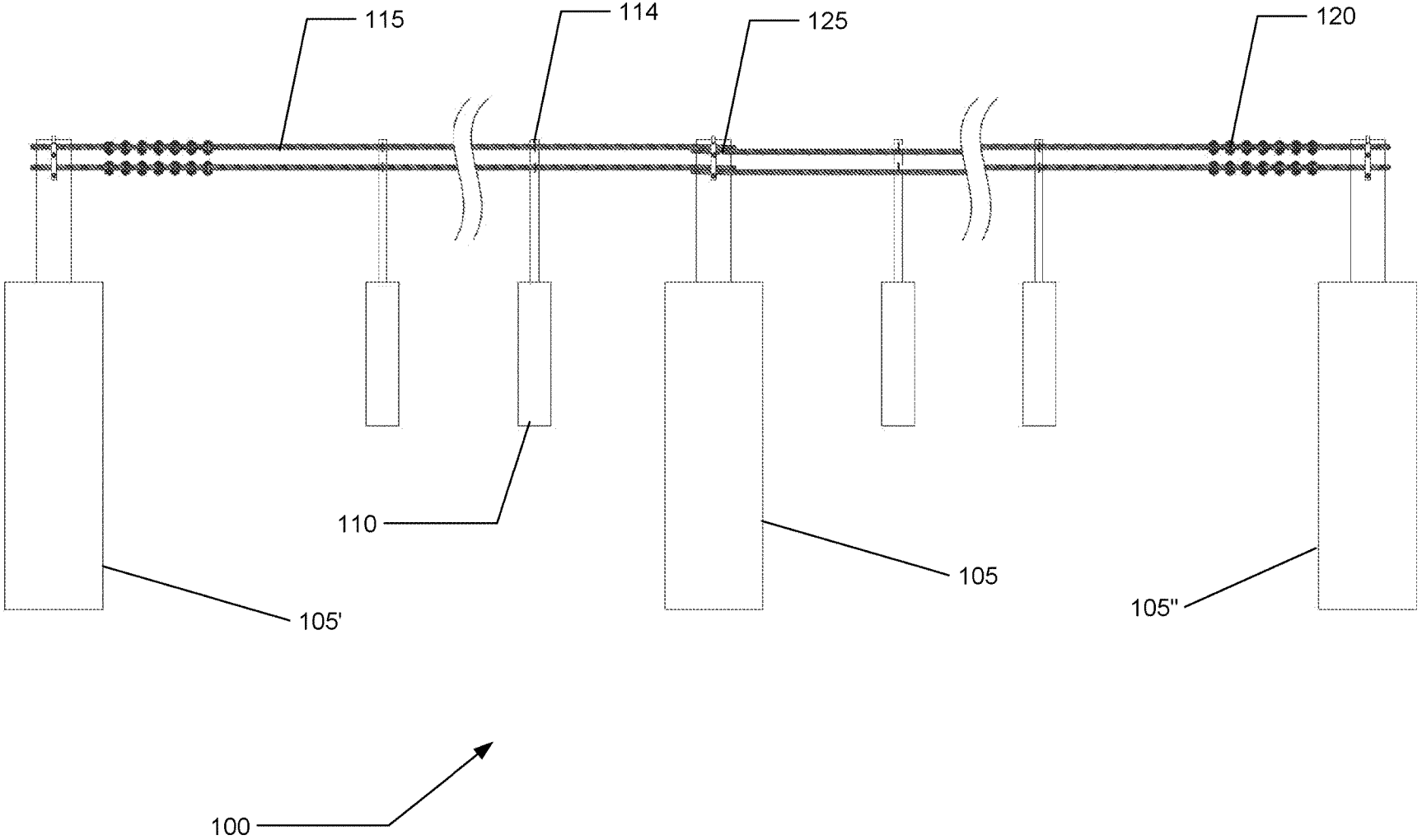
FIG. 3A illustrates a side view of a passive cable barrier system including a double cable configuration, according to an example embodiment of the present disclosure.

FIG. 3A illustrates a side view of a passive cable barrier system 100. Like FIG. 1, the passive cable barrier system 100 in FIG. 3A includes structural posts 105 and guide posts. The passive cable barrier system 100, also includes two sets of cables 115. The cables 115 couple with guide posts 110 at guide connections 114 and couple with structural posts 105 at post connections 125. It should also be noted that the passive cable barrier system 100 includes end cable reinforcements 120 at the proximal and distal structural posts 105 that serve as the "end posts" for the passive cable barrier system 100.

Figure 2A:
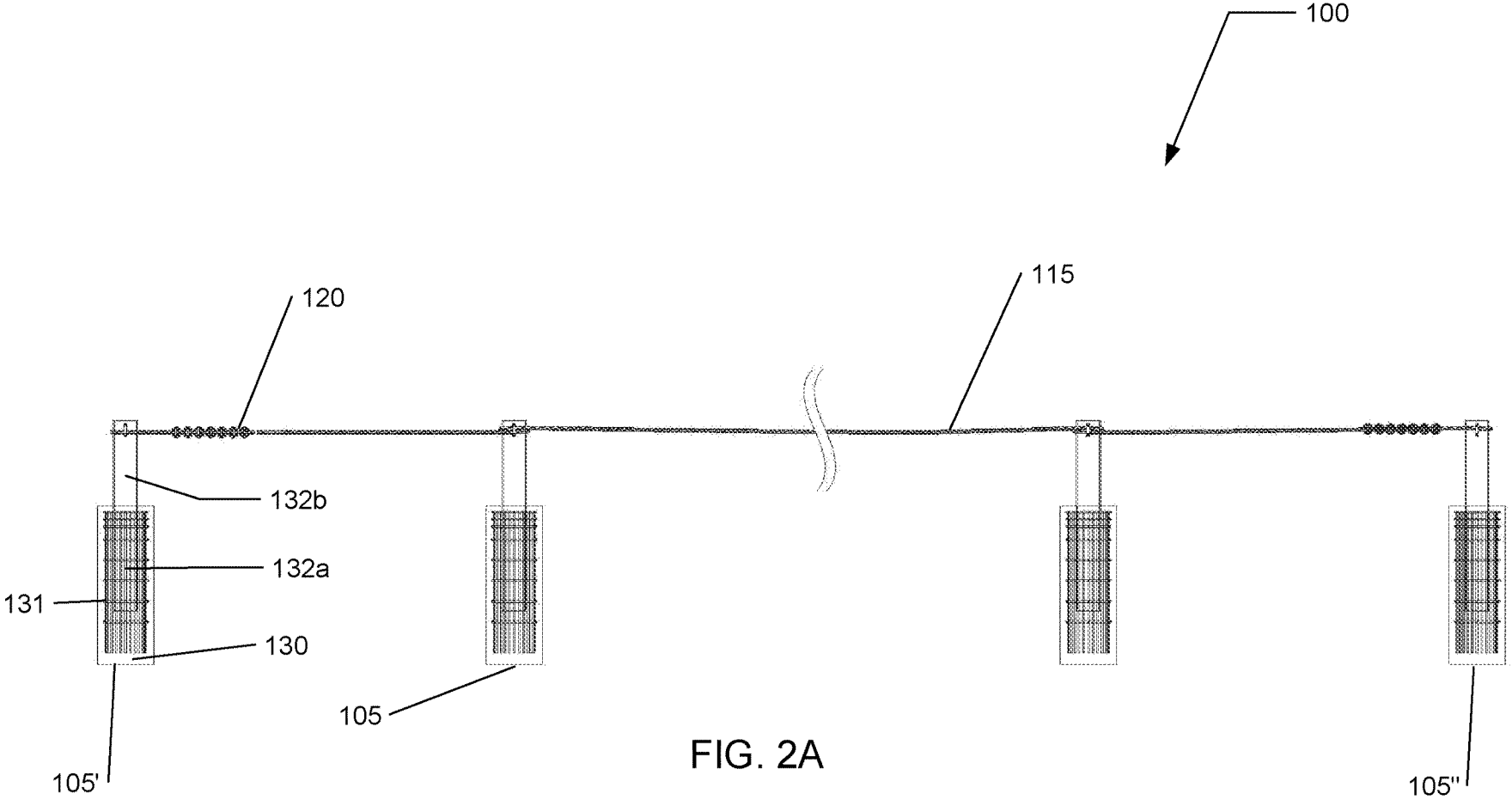
FIG. 2A illustrates a side view of a passive cable barrier system, according to an example embodiment of the present disclosure.

FIG. 2A illustrates a side view of a passive cable barrier system 100. Unlike FIG. 1, FIG. 2A shows an alternate embodiment that includes structural posts 105', 105", 105 and a single cable 115, but does not include guide posts 110 (seen in FIG. 1).

Post Connections and Guide Connections

Figure 3B:
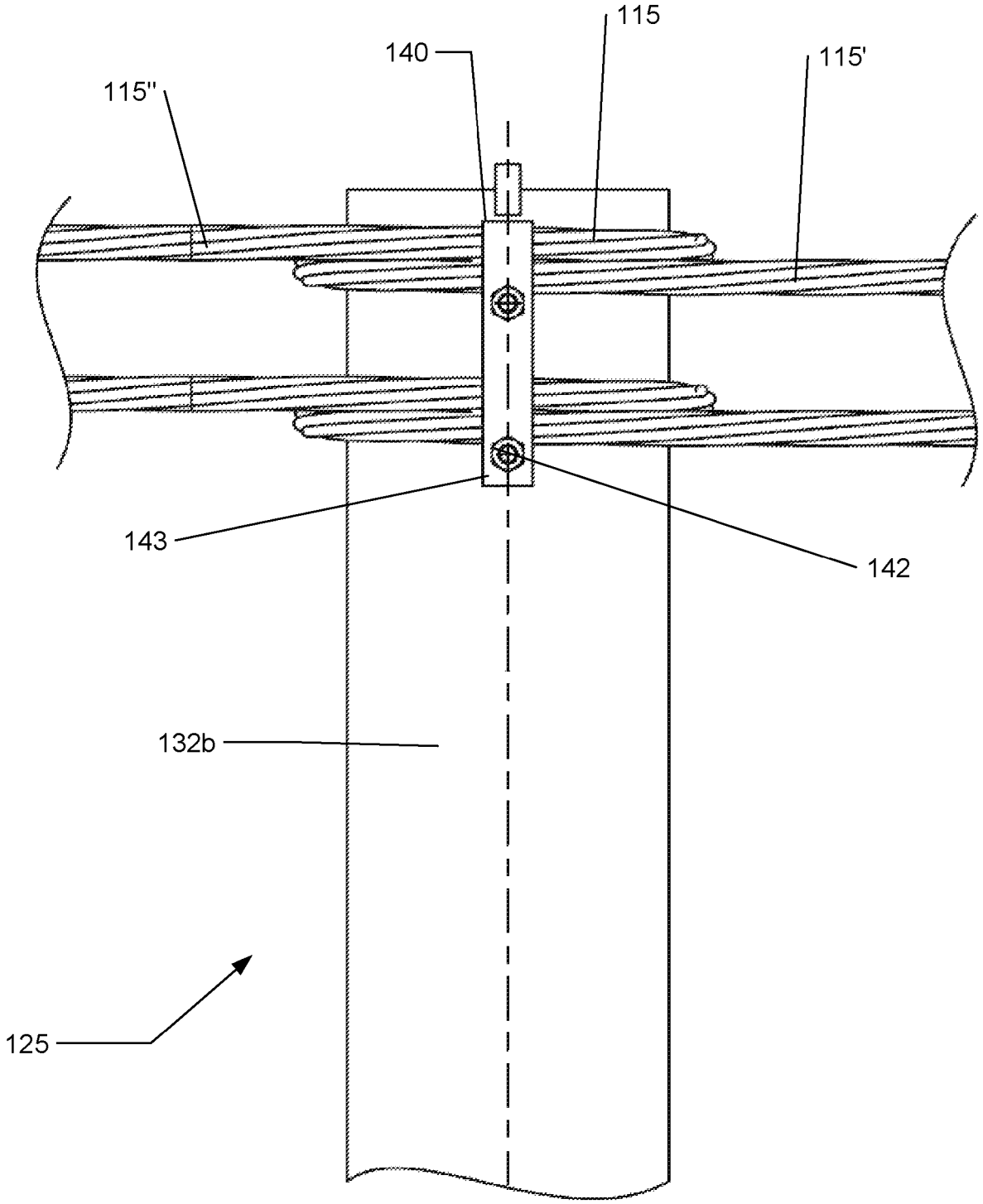
FIG. 3B illustrates a close up side view of a post connection in a passive cable barrier system including a double cable configuration, according to an example embodiment of the present disclosure.

FIG. 3B illustrates a close up side view of a post connection 125 in a passive cable barrier system 100. The post connection 125 is located on the above-ground structural arm 132*b* and includes a cable retention mechanism 140. The post connection 125 secures the single or multiple cables 115 to the structural post 105 at the above-ground structural arm 132*b*. During installation, the user coils or wraps the cable 115 around the above-ground structural arm 132*b* such that a first cable end 115' points in a first direction and a second cable end 115" points in a second direction such that the first and second direction are different. The configuration of the cable 115 and resulting tension around the arm 132*b* are the primary methods for maintaining the cable 115 at the desired height. Next, the user further secures the cable 115 to the arm 132*b* using the cable retention mechanism 140, as described in detail below.

Figure 4A:
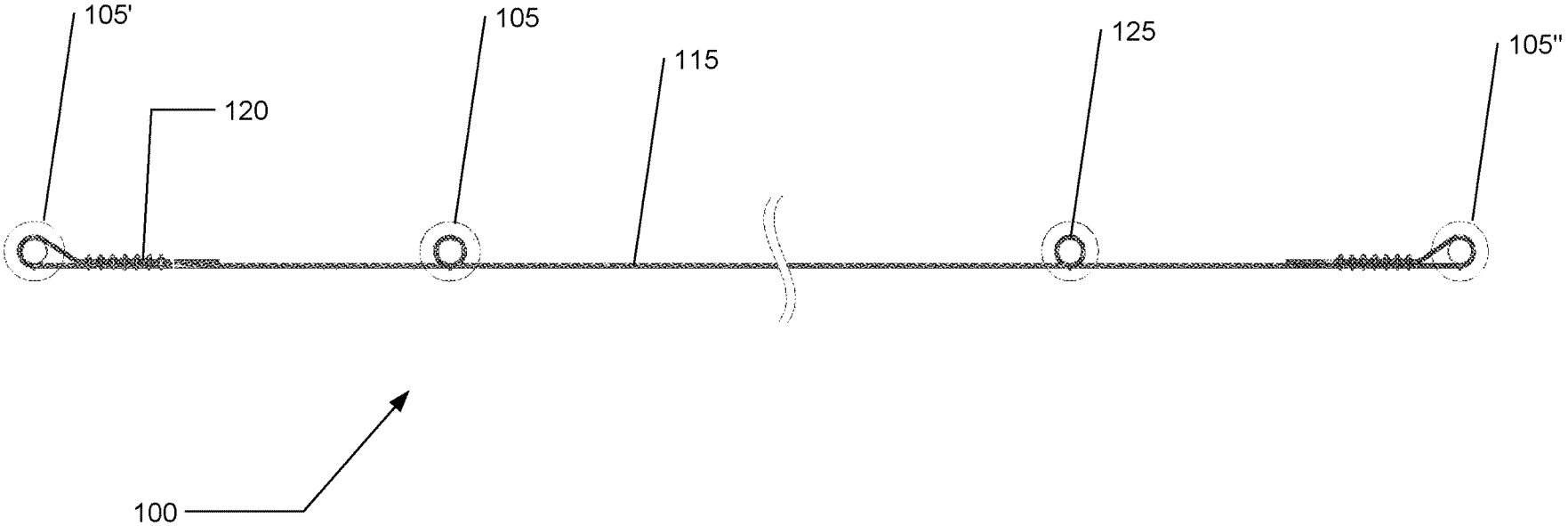
FIG. 4A illustrates a top view of a passive cable barrier system, according to an example embodiment of the present disclosure
Figure 4B:
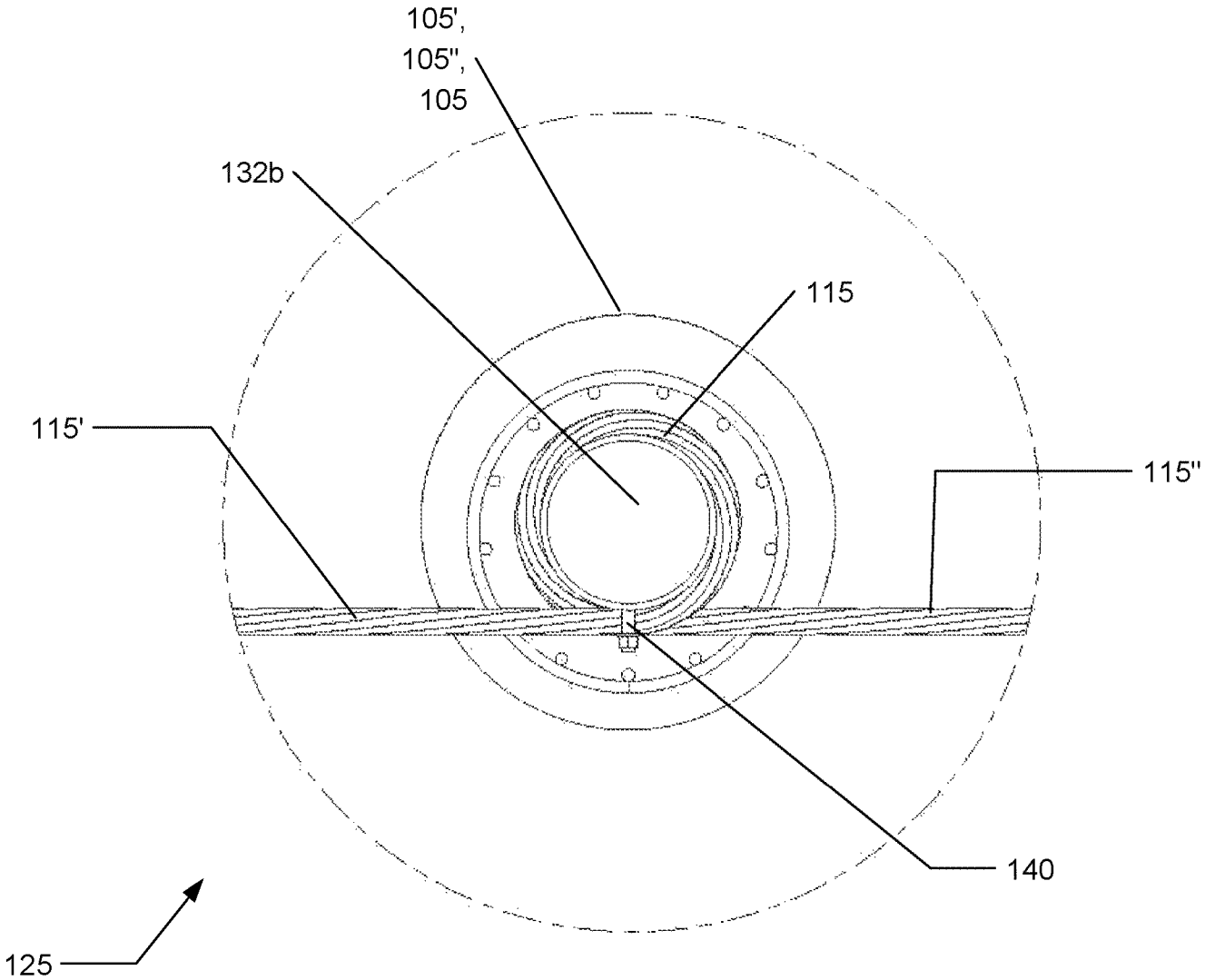
FIG. 4B illustrates a top view of a middle structural post connection in a passive cable barrier system, according to an example embodiment of the present disclosure.

Relatedly, FIG. 4B illustrates a top view of a post connection 125 in a passive cable barrier system 100, as configured in a middle structural post 105. As seen in FIG. 4B, the post connection 125 includes a cable 115 wrapped around the above-ground portion of the structural arm 132*b* for the structural post 105', 105", 105. The cable 115 couples with the structural posts 105', 105", 105 with a cable retention mechanism 140, as noted above. Further, as also previously noted, for post connections 125 involving middle posts 105, the cable 115 is wrapped around the structural arm 132*b* such that a first cable end 115' points in one direction towards another structural post 105 or a guide post 110 (not shown) and a second cable end 115" points in a second direction towards a different structural post 105 or a guide post 110. The first and second directions can vary depending on the respective location of other structural 105 or guide posts 110, and the overall shape of the boundary protected by the passive cable barrier system 100. Additionally, the cable 115 is tightly wrapped around the above-ground portion of the structural arm 132*b* and routed to other structural posts 105 or guide posts 110 such that there is constant tension on the cable 115 throughout the entire passive cable barrier system 100.

Figure 3C:
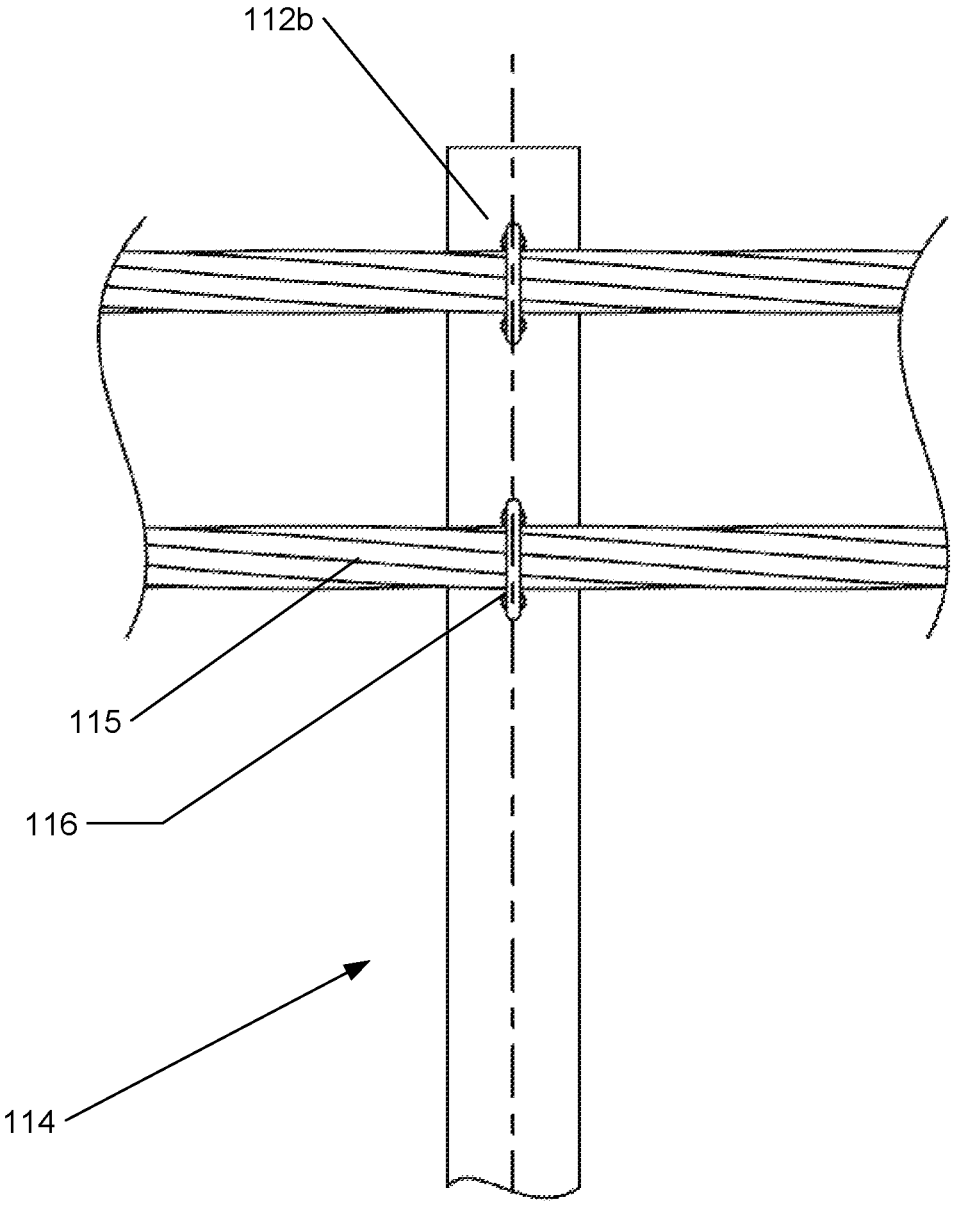
FIG. 3C illustrates a close up side view of guide connection in a passive cable barrier system including a double cable configuration, according to an example embodiment of the present disclosure.

Similarly, FIG. 3C illustrates a close up side view of a guide connection 114 in a passive cable barrier system 100. The guide connection 114 is located on the above-ground guide arm 112*b* and includes a cable guide mechanism 116. The guide connection 114 secures the cables 115, or single cable 115 in alternate embodiments, to the guide post 110. During installation, the user secures the cables 115 on the above-ground guide arm 112*b* using a coupler 116, such as a lightweight industrial staple. It should be noted that the guide posts 110 serve to route the cables 115 to the nearest structural posts 105 and maintain the cables 115 at a constant height. As such, unlike the installation in the structural posts 105, the cables 115 in the guide connection 114 do not wrap or coil around the guide arm 112.

Figure 2B:
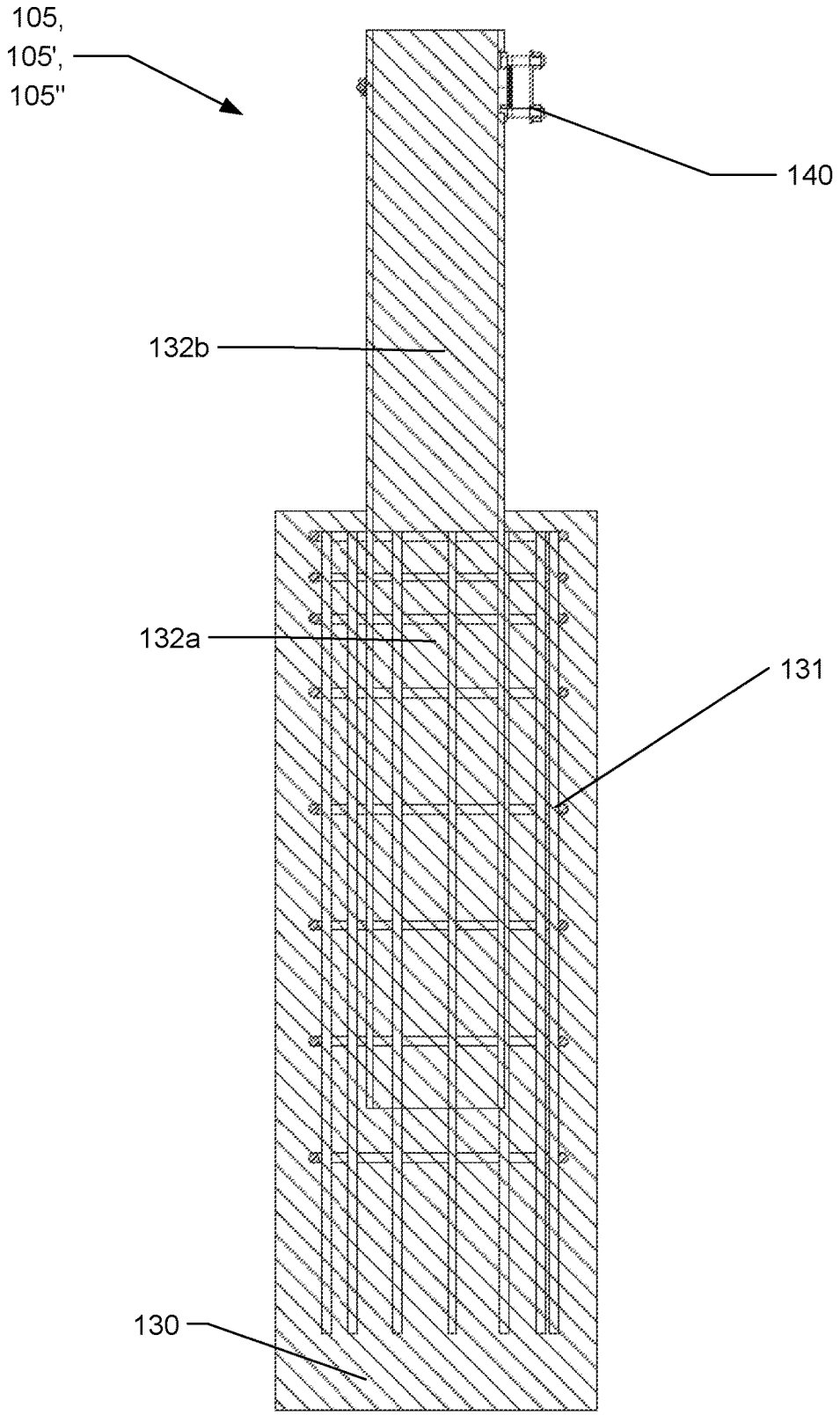
FIG. 2B illustrates a side view of a structural post, according to an example embodiment of the present disclosure.

Next, FIG. 2B illustrates a side view of a structural post 105', 105", 105. The post 105', 105", 105 includes a structural base 130 with a structural reinforcement 131. The structural base 130 is made of a durable material, such as concrete, and includes the structural reinforcement 131, such as a rebar frame. In this embodiment, the structural base 130 is installed underground. However, in alternate embodiments the structural base 130 can be installed partially above ground. Also, a person skilled in the art can modify the composition of the structural base 130 and/or structural reinforcement 131 such that it withstands the forces associated with a vehicular collision or large impact. A structural arm with a subterranean portion 132*a* and an above-ground portion 132*b* is coupled to the structural base 130. Specifically, the structural arm subterranean portion 132*a* couples with the structural base 130. In this embodiment, when the structural base 130 is made by pouring wet concrete, the structural arm subterranean portion 132*a* is inserted into the wet concrete, adjusted to a desired height, and it remains coupled to the structural base 130 once the concrete dries. In alternate embodiments, the wet concrete is poured and dries to create the structural base 130, then a hole is drilled into the structural base 130, the structural arm subterranean portion 132*a* is inserted into the hole at a desired height, concrete is poured to fill the hole with the structural arm subterranean portion 132*a* in it, and the structural arm subterranean portion 132*a* remains coupled to the structural base 130 once the concrete dries. A person skilled in the art can modify the manner in which the structural arm subterranean portion 132*a* couples to the structural base 130. Also, the structural arm above-ground portion 132*b* and structural arm subterranean portion 132*a* are made of a durable, light material that can withstand the force of a vehicular collision or similar impact. The structural arm above-ground portion 132*b* includes a cable retention mechanism 140, further described below with respect to 2C.

Similarly, as seen in FIG. 1, the guide posts 110 include a guide base 111 and a guide arm with a subterranean portion 112*a* and an above-ground portion 112*b*. The guide base 111 is made of a durable material, like concrete. In this embodiment, the guide base 111 is installed underground. However, in alternate embodiments the guide base 111 can be installed partially above ground. A guide arm with a subterranean portion 112*a* and an above-ground portion 112*b* is coupled to the guide base 111. Specifically, the guide arm subterranean portion 112*a* couples with the guide base 111. In this embodiment, when the guide base 111 is made by pouring wet concrete, the guide arm subterranean portion 112*a* is inserted into the wet concrete, adjusted to a desired height, and it remains coupled to the guide base 111 once the concrete dries. In alternate embodiments, the wet concrete is poured and dries to create the guide base 111, then a hole is drilled into the guide base 111, the guide arm subterranean portion 112*a* is inserted into the hole at a desired height, concrete is poured to fill the hole with the guide arm subterranean portion 112*a* in it, and the guide arm subterranean portion 112*a* remains coupled to the guide base 111 once the concrete dries. A person skilled in the art can modify the manner in which the guide arm subterranean portion 112*a* couples to the guide base 111. Also, the guide arm above-ground portion 112*b* and guide arm subterranean portion 112*a* are made of a light material and can be, for example, a u-channel or square sign post. The guide arm above-ground portion 112*b* includes a guide connection 114, as described above. Guide posts 110 are intended to direct the cables 115; guide posts 110 are not intended to provide a structural purpose (e.g., preventing the cables 115 from displacing as a result of experiencing forces associated with vehicular collisions or similar impact). As such, a person skilled in the art would understand that they could modify the material and design used for the guide arm subterranean portion 112*a* and above ground portion 112*b* accordingly.

Figure 2C:
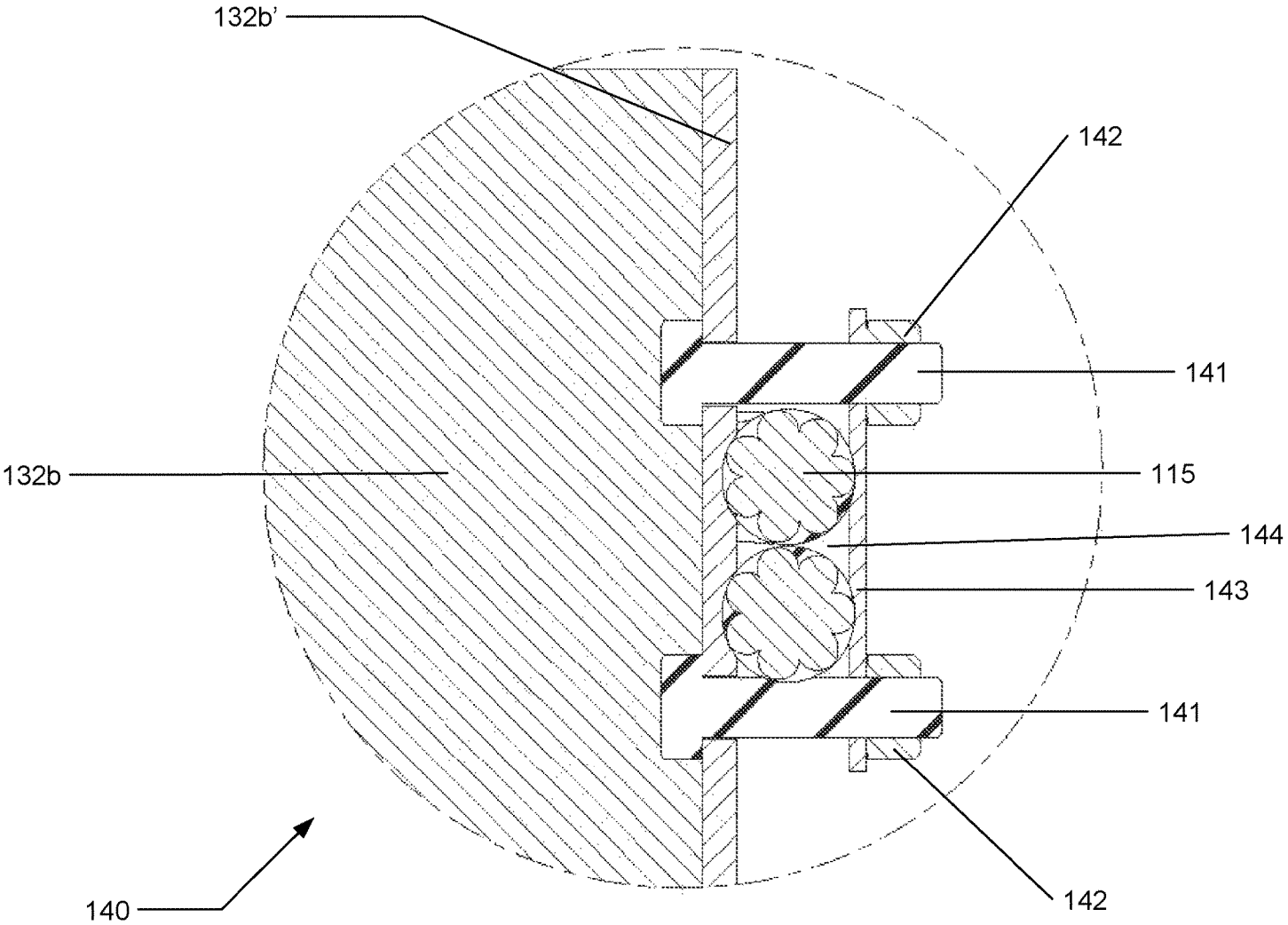
FIG. 2C illustrates a close up sectional view of a cable retention mechanism, according to an example embodiment of the present disclosure.

FIG. 2C illustrates a cable retention mechanism 140. As previously noted, the cable retention mechanism 140 is part of the above-ground portion of the structural arm 132*b*. The cable retention mechanism includes cable guides 141, a plate 143, and fasteners 142. In one embodiment, the cable guides 141 can be integrally coupled with the structural arm 132*b* for example in the structural arm edge 132*b*'. Specifically, in this embodiment, the structural arm 132*b* is made of concrete and the cable guides 141 are bolts that are placed in the structural arm 132*b* when the concrete is wet, such that the cable guides 141 extend outwardly from the structural arm edge 132*b*' at a desired height, and remain coupled to the structural arm 132*b* once the concrete dries. In an alternate embodiment, the structural arm edge 132*b*' includes an aperture through which one end of the cable guides 141, which are bolts, passes such that the body of the bolt extends from the structural arm edge 132*b*' outwardly and the head of the bold remains behind the aperture such it remains engaged with the aperture on the structural arm edge 132*b*'. The user then threads a nut around the bolt to secure it to the structural arm 132*b*.

The cable guides 141 couple to the structural arm 132*b*, such that the guides 141 define a receiving area 144 dimensioned to accommodate the width of at least two coils of a cable 115 wrapped around the structural arm 132*b*. The plate 143 is configured to engage with the cable guides 141, such that the plate lies parallel to the structural arm edge 132*b*' and is secured onto the cable guides 141 with fasteners 142. As such, when the plate 145 is secured onto the cable guides 141, it prevents the cable 115 from falling out of the receiving area 144, and serves to secure the cable 115 between the cable guides 141. A person skilled in the art could modify the cable guides 141, plate 143, and/or fasteners 142 to accommodate differently sized cables 115, different numbers of cable coils around the structural arm 132*b*, and to withstand the forces associated with the friction and tension resulting from the cable 115 receiving the force of vehicular collision or similar impact.

End Cable Reinforcements

FIG. 4A illustrates a top view of a passive cable barrier system 100. As noted above, the passive cable barrier system 100 includes structural posts 105 and a cable 115. Specifically, the passive cable barrier system 100 includes a distal structural post 105', a proximal structural post 105", and middle structural posts 105. The distal and proximal posts 105', 105" serve as "end posts" with the middle structural posts 105 interspersed at intervals between them. As also previously noted, a cable 115 is secured to the posts 105', 105", 105 at a desired height. Notably, the cable 115 is secured to the posts 105', 105", 105 via post connections 125. However, the end posts 105', 105" also include end cable reinforcements 120.

Figure 4C:
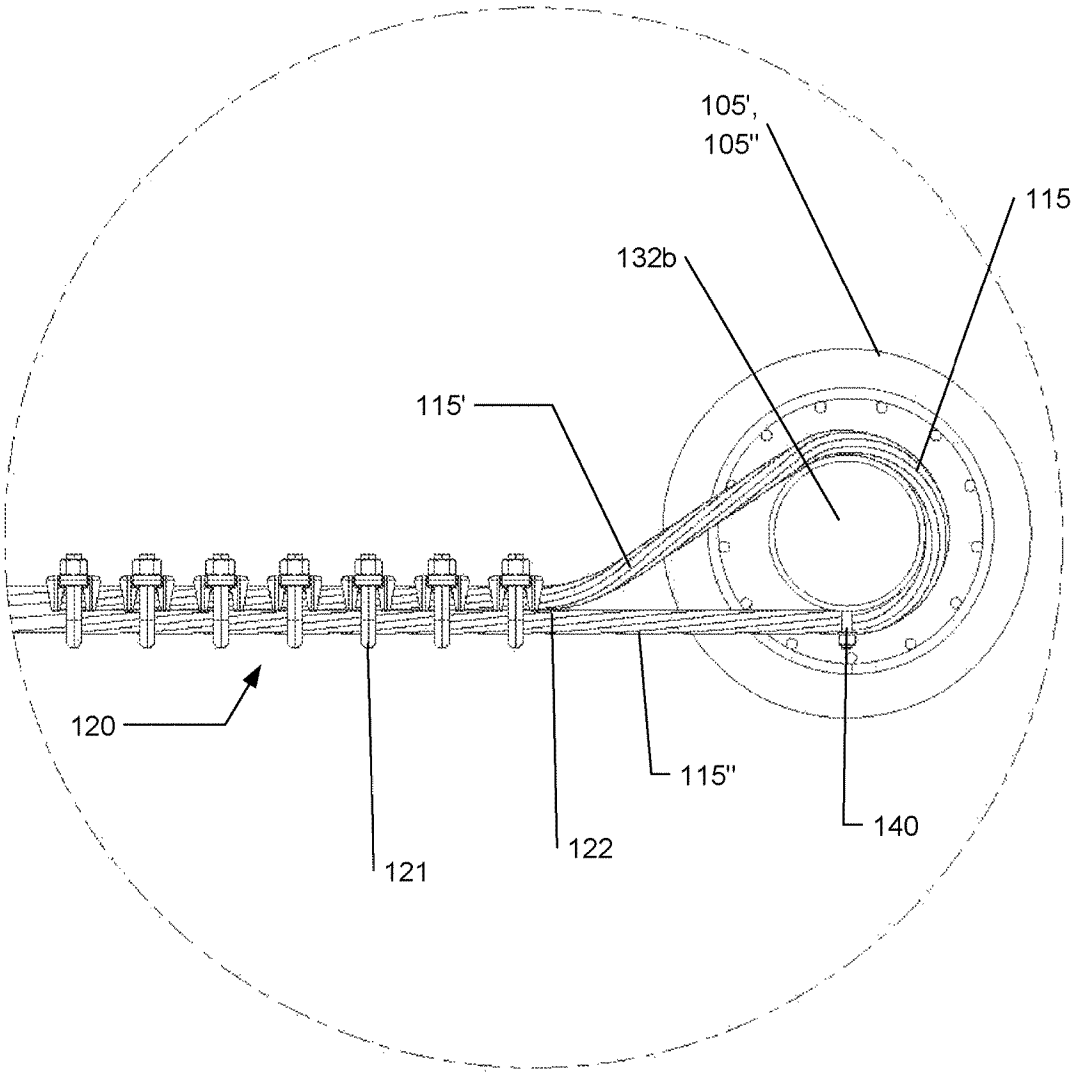
FIG. 4C illustrates a top view of an end cable reinforcement in a passive cable barrier system, according to an example embodiment of the present disclosure.

FIG. 4C illustrates a top view of an end cable reinforcement 120 in a passive cable barrier system 100. As seen in FIG. 4C, the reinforcement 120 includes a cable 115 wrapped around the above-ground portion of the structural arm 132*b* for an end post 105', 105". The cable 115 couples with the end posts 105', 105" with a cable retention mechanism 140, as noted above. Importantly, the cable 115 is wrapped around the structural arm 132*b* such that both a first cable end 115' and a second cable end 115" point in the same direction towards another structural post 105 or a guide post 110 (not shown). As such, the first and second cable ends 115', 115" meet at a convergence point 122. Importantly, the convergence point 122 is the point at which bringing the cable ends 115', 115" together maintains the tension in the cable 115 around the structural arm 132*b* such that the cable 115 remains at a desired height. The cable ends 115', 115" are fixedly coupled to each other using a fixing mechanism 121 at the convergence point 122. In this embodiment, the fixing mechanism includes nuts and bolts that can be quickly removed or replaced using, for example, an industrial drill or a ratchet and socket. As such, the fixing mechanism 121 does not use specialized parts or require special skills to install. Moreover, the fixing mechanism 121 can be replaced at a low cost, since the components of the fixing mechanism are not specially made or specific to the passive cable barrier system 100. As seen in FIG. 4C, the reinforcement 120 includes a plurality of fixing mechanisms 121. A person skilled in the art can modify the number of fixing mechanisms 121 used, the type of fixing mechanisms 121, and the material of the fixing mechanisms. 121.

Vehicular Collisions & Other Forces Applied

The passive cable barrier system 100, as seen in FIGS. 1, 2A, and 3A primarily prevents access to restricted areas by creating a boundary around said areas. The cables 115, in some embodiments singular cable 115, are installed at a desired height, such as a car height, and fixed at the desired height using the tension created on the cables 115 by the configuration of post connections 125. Moreover, in some embodiments, the passive cable barrier system 100 includes guide posts 110 (as seen in FIGS. 1 and 3A), which server to direct the cables 115 and help maintain the cables 115 at a desired height. Importantly, the passive cable barrier system 100 includes distal and proximal structural posts 105', 105" which include end cable reinforcements 120, also help maintain tension throughout the length of the cables 115.

Importantly, when a large impact force, such as a vehicular collision, is placed on the cables 115, the force is transferred through the cables 115 and through to the post connections 125. As a result of the configuration of the post connections 125 and the starting tension on the cables, the force is transferred to the cables 115 at the post connections 125, such that it "locks" the cable 115 by further tightening the cable around the above-ground structural arm 132*b*. As such, the section of the cables 115 which receives the large impact force increases in tension such that, for example, the vehicle is stopped, and other sections of the cables 115 receive little-to-no force from the large impact, as the force is dissipated. Additionally, because the passive cable barrier system 100 does not use specialized tools or welding to install, it can be set up, removed, and transported quickly. The passive cable barrier system 100 also does not rely on specialized parts, like custom fittings, which means it can be quickly and inexpensively fixed in situations where a component needs replacement.

It should be noted that in one embodiment, the passive cable barrier system complies with the standards in ASTM M50/P2, M50/P1 and M30/P1. However, in alternate embodiments, the passive cable barrier system complies with additional standards. While this application generally discussed the use of a passive cable barrier system to restrict access to vehicles, it should be appreciated that the passive cable barrier system discussed can be used to restrict access when experiencing a large impact force, such as battering ram use or crowds.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

The invention claimed is:

1. A passive cable barrier system comprising:

at least one cable;

a first structural post that comprises a first structural base and a first structural arm that is fixedly coupled to the first structural base, wherein the first structural arm comprises a first post connection to which the at least one cable is fixedly attached;

wherein the first post connection is configured such that at least one cable wraps around the first structural arm such that the at least one cable makes at least one revolution around the first structural arm;

wherein the first post connection is further configured such that a force on the at least one cable increases tension on opposing cable portions of the at least one cable in contact with the first structural arm, to tighten the at least one cable about the first structural arm;

wherein the cable portions contact opposed surface portions of an exterior surface of the first structural arm such that tension applied to one of the cable portions tightens another of the cable portions against an opposed surface portion of the exterior surface of the first structural arm;

a second structural post that comprises a second structural base and a second structural arm that is fixedly coupled to the second structural base, wherein the second structural arm comprises a second post connection to which the at least one cable is fixedly attached; and at least one guide post that each comprise a guide base and a guide arm cable retention mechanism that is attached to the guide base, wherein the guide arm cable retention mechanism slidably receives the at least one cable to maintain the at least one cable at a height wherein the at least one guide post is positioned intermediate the first structural post and the second structural post and wherein at least one guide post is not capable of preventing the at least one cable from displacing as a result of experiencing forces associated with vehicular collisions or similar impacts, and wherein a guide arm of the at least one guide post is comprised of at least one of a u-channel post or a square sign post.

2. The passive cable barrier system of claim 1, and further comprising a third structural post that comprises a third structural base and a third structural arm that is fixedly coupled to the third structural base, wherein the third structural arm comprises a third post connection to which the at least one cable is fixedly attached and wherein the third structural post is fixedly attached to the at least one cable intermediate the first structural post and the second structural post.

3. The passive cable barrier system of claim 1, wherein the first and second structural posts further comprise an end cable reinforcement and wherein the first and second structural base further comprise a structural reinforcement.

4. The passive cable barrier system of claim 1, wherein the first post connection comprises the at least one cable wrapping around the first structural arm such that the at least one cable makes at least one revolution around the first structural arm, wherein the second post connection comprises the at least one cable wrapping around the second structural arm such that the at least one cable makes at least one revolution around the second structural arm and wherein a first end of the at least one cable is directed in a first direction and a second end of the at least one cable is directed in a second different direction, such that there is tension on the at least one cable around the first structural arm and the second structural arm.

5. The passive cable barrier system of claim 4, wherein the first post connection further comprises a cable retention mechanism that defines a cable receiving area on the first structural arm and is configured to receive the at least one cable at a point where the first end of the at least one cable and second end of the at least one cable intersect, such that the at least one cable receiving area is configured to receive at least two portions of the at least one cable.

6. The passive cable barrier system of claim 1, wherein the increase in tension on the cable portions increases a normal force between the at least one cable and the first structural arm, thereby increasing frictional engagement between the at least one cable and the first structural arm and resisting slippage of the at least one cable relative to the first structural arm.

7. The passive cable barrier system of claim 6, wherein the first post connection is configured to lock the at least one cable against movement relative to the first structural arm in response to the increase in tension on the cable portions.

8. A passive cable barrier system comprising:

at least one cable;

a first structural post that comprises a first structural base and a first structural arm that is fixedly coupled to the first structural base, wherein the first structural arm comprises a first post connection to which the at least one cable is fixedly attached;

a second structural post that comprises a second structural base and a second structural arm that is fixedly coupled to the second structural base, wherein the second structural arm comprises a second post connection to which the at least one cable is fixedly attached;

wherein the first post connection comprises the at least one cable wrapping around the first structural arm such that the at least one cable makes at least one revolution around the first structural arm;

wherein the first post connection is further configured such that a force on the at least one cable increases tension on opposing cable portions of the at least one cable in contact with the first structural arm, to tighten the at least one cable about the first structural arm;

wherein the cable portions contact opposed surface portions of an exterior surface of the first structural arm such that tension applied to one of the cable portions tightens another of the cable portions against an opposed surface portion of the exterior surface of the first structural arm;

a third structural post that comprises a third structural base and a third structural arm that is fixedly coupled to the third structural base, wherein the third structural arm comprises a third post connection to which the at least one cable is fixedly attached and wherein the third structural post is fixedly attached to the at least one cable intermediate the first structural post and the second structural post; and at least one guide post that each comprise a guide base and a guide arm cable retention mechanism that is attached to the guide base, wherein the guide arm cable retention mechanism slidably receives the at least one cable to maintain the at least one cable at a height wherein the at least one guide post is positioned intermediate the first structural post and the second structural post and wherein at least one guide post is not capable of preventing the at least one cable from displacing as a result of experiencing forces associated with vehicular collisions or similar impacts, and wherein a guide arm of the at least one guide post is comprised of at least one of a u-channel post or a square sign post.

9. The passive cable barrier system of claim 8, wherein the first and second structural posts further comprise an end cable reinforcement and wherein the first and second structural base further comprise a structural reinforcement.

10. The passive cable barrier system of claim 8, wherein the first post connection comprises the at least one cable wrapping around the first structural arm such that the at least one cable makes at least one revolution around the first structural arm, wherein the second post connection comprises the at least one cable wrapping around the second structural arm such that the at least one cable makes at least one revolution around the second structural arm and wherein a first end of the at least one cable is directed in a first direction and a second end of the at least one cable is directed in a second different direction, such that there is tension on the at least one cable around the first structural arm and the second structural arm.

11. The passive cable barrier system of claim 10, wherein the first post connection further comprises a cable retention mechanism that defines a cable receiving area on the first structural arm and is configured to receive the at least one cable at a point where the first end of the at least one cable and second end of the at least one cable intersect, such that the at least one cable receiving area is configured to receive at least two portions of the at least one cable.

12. The passive cable barrier system of claim 8, wherein the increase in tension on the cable portions increases a normal force between the at least one cable and the first structural arm, thereby increasing frictional engagement between the at least one cable and the first structural arm and resisting slippage of the at least one cable relative to the first structural arm.

13. A method of operating a passive cable barrier system comprising:

mounting a first structural post to a ground surface, wherein the first structural post comprises a first structural base and a first structural arm that is fixedly coupled to the first structural base, wherein the first structural arm comprises a first post connection;

fixedly attaching at least one cable to the first post connection;

wherein the first post connection comprises the at least one cable wrapping around the first structural arm such that the at least one cable makes at least one revolution around the first structural arm;

wherein the first post connection is further configured such that a force on the at least one cable increases tension on opposing cable portions of the at least one cable in contact with the first structural arm, to tighten the at least one cable about the first structural arm;

wherein the cable portions contact opposed surface portions of an exterior surface of the first structural arm such that tension applied to one of the cable portions tightens another of the cable portions against an opposed surface portion of the exterior surface of the first structural arm;

mounting a second structural post to the ground surface, wherein the second structural post comprises a second structural base and a second structural arm that is fixedly coupled to the second structural base, wherein the second structural arm comprises a second post connection;

fixedly attaching the at least one cable to the second post connection so that the at least one cable is under tension;

providing at least one guide post that each comprise a guide base and a guide arm cable retention mechanism that is attached to the guide base; and slidably receiving the at least one cable in the guide arm cable retention mechanism slidably to maintain the at least one cable at a height wherein the at least one guide post is positioned intermediate the first structural post and the second structural post and wherein at least one guide post is not capable of preventing the at least one cable from displacing as a result of experiencing forces associated with vehicular collisions or similar impacts, and wherein the at least one cable does not wrap or coil around the guide arm cable retention mechanism.

14. The method of operating the passive cable barrier system of claim 13, and further comprising: mounting a third structural post in the ground surface intermediate the first structural post and the second structural post, wherein the third structural post comprises a third structural base and a third structural arm that is fixedly coupled to the third structural base, wherein the third structural arm comprises a third post connection; and fixedly attaching the at least one cable to the third post connection.

15. The method of operating the passive cable barrier system of claim 13, and further comprising: reinforcing the first and second structural posts with end cable reinforcements; and reinforcing the first structural base and the second structural base with a structural reinforcement.

16. The method of operating the passive cable barrier system of claim 13, wherein the fixedly attaching the at least one cable to the first post connection comprises wrapping the at least one cable wrapping around the first structural arm such that the at least one cable makes at least one revolution around the first structural arm, wherein the fixedly attaching the at least one cable to the second post connection comprises wrapping the at least one cable wrapping around the second structural arm such that the at least one cable makes at least one revolution around the second structural arm and wherein a first end of the at least one cable is directed in a first direction and a second end of the at least one cable is directed in a second direction, such that there is tension on the at least one cable around the first structural arm and the second structural arm.

17. The method of operating the passive cable barrier system of claim 16, wherein the first post connection further comprises a cable retention mechanism that defines a cable receiving area on the first structural arm and wherein the method further comprises receiving the at least one cable at a point where the first end of the at least one cable and second end of the at least one cable intersect, such that the at least one cable receiving area is configured to receive at least two portions of the at least one cable.

18. The method of claim 13, wherein increasing the tension on the cable portions increases a normal force between the at least one cable and the first structural arm, thereby increasing frictional engagement between the at least one cable and the first structural arm and resisting slippage of the at least one cable relative to the first structural arm.

19. The method of claim 13, wherein tightening the at least one cable about the first structural arm comprises transferring tension from a loaded portion of the at least one cable to a wrapped portion of the at least one cable to increase frictional engagement between the wrapped portion and the first structural arm.

* * * * *